US011011293B2

(12) United States Patent
Miyamoto

(10) Patent No.: US 11,011,293 B2
(45) Date of Patent: May 18, 2021

(54) INDUCTOR COMPONENT

(71) Applicant: Murata Manufacturing Co., Ltd., Kyoto-fu (JP)

(72) Inventor: Masashi Miyamoto, Nagaokakyo (JP)

(73) Assignee: Murata Manufacturing Co., Ltd., Kyoto-fu (JP)

( * ) Notice: Subject to any disclaimer, the term of this patent is extended or adjusted under 35 U.S.C. 154(b) by 94 days.

(21) Appl. No.: 15/802,604

(22) Filed: Nov. 3, 2017

(65) Prior Publication Data

US 2018/0182528 A1 Jun. 28, 2018

(30) Foreign Application Priority Data

Dec. 26, 2016 (JP) ..... JP2016-251164

(51) Int. Cl.
*H01F 27/24* (2006.01)
*H01F 5/04* (2006.01)
*H01F 27/29* (2006.01)

(52) U.S. Cl.
CPC ..... *H01F 27/24* (2013.01); *H01F 5/04* (2013.01); *H01F 27/292* (2013.01)

(58) Field of Classification Search
CPC ..... H01F 27/24; H01F 5/04; H01F 27/292
USPC ..... 336/83, 187–189, 192, 220–222
See application file for complete search history.

(56) References Cited

U.S. PATENT DOCUMENTS

2003/0071704 A1* 4/2003 Toi ..... H01F 17/045 336/83
2006/0066430 A1* 3/2006 Nakano ..... H01F 27/255 336/120
2007/0046413 A1* 3/2007 Yamashita ..... H01F 17/045 336/96
2008/0309445 A1* 12/2008 Suzuki ..... H01F 27/2823 336/183

(Continued)

FOREIGN PATENT DOCUMENTS

JP 2004-363178 A 12/2004
JP 2005-044858 A 2/2005

(Continued)

OTHER PUBLICATIONS

An Office Action; "Notification of Reasons for Refusal," Mailed by the Japanese Patent Office dated Feb. 12, 2019, which corresponds to Japanese Patent Application No. 2016-251164 and is related to U.S. Appl. No. 15/802,604; with English language translation.

(Continued)

*Primary Examiner* — Tszfung J Chan
(74) *Attorney, Agent, or Firm* — Studebaker & Brackett PC

(57) ABSTRACT

An inductor component includes a drum core including a winding core portion extending along a longitudinal direction and a pair of flange portions disposed on end portions of the winding core portion, a plate core bonded to the pair of flange portions, and a wire wound around the winding core portion. The drum core and the plate core are made of a magnetic material. An average distance between the plate (Continued)

core and the pair of flange portions is no less than about 20 μm and no more than about 50 μm. The wire includes aligned banked winding portions arranged along the longitudinal direction and more than half of a total number of turns of the wire belong to the aligned banked winding portions.

7 Claims, 10 Drawing Sheets

(56) References Cited

U.S. PATENT DOCUMENTS

2010/0214050 A1 8/2010 Opina, Jr. et al.
2010/0271160 A1* 10/2010 Tomonari ..... H01F 19/04 336/65
2012/0133469 A1* 5/2012 Tomonari ..... H01F 3/14 336/192
2013/0154788 A1* 6/2013 Morimoto ..... H01F 5/00 336/221
2015/0090834 A1* 4/2015 Inubushi ..... B65H 75/26 242/600
2017/0025212 A1* 1/2017 Jerez ..... H01F 17/045
2017/0263372 A1* 9/2017 Ashizawa ..... H01F 27/2823

FOREIGN PATENT DOCUMENTS

JP 005044858 A * 2/2005
JP 2005044858 A * 2/2005
JP 2009224649 A * 10/2009
JP 2012-114369 A 6/2012
JP 2014-082343 A 5/2014
JP 2014082343 A * 5/2014 ..... H01F 27/29
JP 2016-086034 A 5/2016
JP 2016-086122 A 5/2016
JP 2016-195289 A 11/2016

OTHER PUBLICATIONS

An Office Action; "Notification of Reasons for Refusal," Mailed by the Japanese Patent Office dated Jun. 4, 2019, which corresponds to Japanese Patent Application No. 2016-251164 and is related to U.S. Appl. No. 5/802,604; with English language translation.

* cited by examiner

INDUCTOR COMPONENT

CROSS REFERENCE TO RELATED APPLICATIONS

This application claims benefit of priority to Japanese Patent Application 2016-251164 filed Dec. 26, 2016, the entire content of which is incorporated herein by reference.

TECHNICAL FIELD

The present disclosure relates to an inductor component and in particular to a wire-wound inductor component having a structure in which a plate core bonded to a pair of flange portions of a drum core and wire is wound around a winding core portion of the drum core.

BACKGROUND

An inductor component including a drum core made of a magnetic material can achieve high inductance by bonding a plate core made of a magnetic material to the drum core such that the plate core spans a distance between a pair of flange portions in the drum core and thus forming a closed magnetic circuit.

However, this configuration is effective only for uses in low frequencies in ordinary cases because it utilizes the characteristic in which the relative permeability of ferrite is high.

It is known that generally an inductor component including a plate core made of a magnetic material possess degraded direct-current superimposition characteristics. Thus, the inductor component may have a gap between the drum core and the plate core with the aim of improving the direct-current superimposition characteristics, as described in, for example, Japanese Unexamined Patent Application Publication No. 2004-363178 and the like. This closed magnetic circuit structure having the gap can suppress the magnetic saturation and improve the direct-current superimposition characteristics.

SUMMARY

However, the above-described closed magnetic circuit structure with the gap can improve the direct-current superimposition characteristics, but is subjected to a reduction in the inductance value (L value). To compensate for the reduction in the L value, it is necessary to increase the number of turns of wire. Unfortunately, the space for allowing the wire to be wound is limited, and that limits the number of turns of the wire.

There is a type of multi-layer windings called banked winding. The banked winding is a winding method by which a plurality of multi-layer winding portions where wire is wound around a winding core portion with two or more layers are arranged along the longitudinal direction of the winding core portion. With this banked winding, the wire can be wound with a large number of turns in a limited space. However, with this winding method, the self-resonant frequency of the inductor component is lower and because of large capacitance the impedance largely decreases in higher frequencies than the self-resonant frequency. Thus the banked winding can be considered as a winding method suited for uses in low frequencies in ordinal cases.

Accordingly, it is an object of the present disclosure to provide an inductor component capable of achieving a high inductance, satisfactory direct-current superimposition characteristics, and a high impedance at higher frequencies than its self-resonant frequency.

According to one embodiment of the present disclosure, an inductor component includes a drum core including a winding core portion extending along a longitudinal direction and a pair of flange portions disposed on end portions of the winding core portion, a plate core bonded to the pair of flange portions, and a wire wound around the winding core portion. The drum core and the plate core are made of a magnetic material.

An average distance between the plate core and the pair of flange portions is no less than about 20 μm and no more than about 50 μm. The wire includes aligned banked winding portions arranged along the longitudinal direction of the winding core portion. More than half of a total number of turns of the wire belong to the aligned banked winding portions.

The banked winding needs to have a section where the wire moves from the lower layer side to the upper layer side every some turns. In this section, the wire is returned in a direction opposite to the direction of travel of the wire spirally wound on the winding core portion. This section is hereinafter referred to as return section.

The above-described "aligned banked winding portions" indicates the banked winding portions in which the return section is present in a specific position, such as a predetermined surface of the periphery of the winding core portion.

By setting the gap, in other words, the average distance to "no less than about 20 μm," the direct-current superimposition characteristics can be sufficiently improved. In ordinary cases, the distance between the bonding surfaces when the plate core is bonded to the flange portions is smaller than about 20 μm. The gap of no less than about 20 μm is considered to be an intended gap. By setting the gap to "no more than about 50 μm," the effect of improving the inductance produced by the plate core remains.

According to the embodiment of the present disclosure, the direct-current superimposition characteristics can be improved, the higher frequency characteristics of the L value can be enhanced, the capacitance can be reduced, and satisfactory high frequency characteristics can be achieved.

According to the embodiment of the present disclosure, because the plurality of the aligned banked winding portions are arranged along the longitudinal direction of the winding core portion, the position of resonance is stabilized, and even if the wire is slightly displaced in one of the banked winding portions, the influence on the entire impedance characteristics can be minute.

In the embodiment of the present disclosure, the number of turns of the wire in a lowest layer that is wound in contact with the winding core portion is preferably small and, for example, four or less in each of the aligned banked winding portions. With this configuration, the combined capacitance of stray capacitances occurring in the entire inductor component can be reduced.

In the embodiment of the present disclosure, the wire may include a plurality of kinds of the aligned banked winding portions. "The wire includes a plurality of kinds of the aligned banked winding portions" indicates the wire has different numbers of turns in the different kinds of the aligned banked winding portions. With this configuration, the specific positions where the return section is present in the different kinds of the aligned banked winding portions are different each other.

In the embodiment of the present disclosure, an interval between the adjacent aligned banked winding portions along the longitudinal direction of the winding core portion may be no more than about 30 μm. This configuration can contribute to winding the wire with a larger number of turns around the winding core portion of a limited length, can strengthen the magnetic coupling among the portions constituting banked windings, and can contribute to achieving higher impedance.

In the embodiment of the present disclosure, the wire may include a portion wound in a single layer between the aligned banked winding portions. With this configuration, a discrepancy between the position of the wire recognized by a winding machine and an actual position of the wire that may occur in a process for winding the wire can be compensated for by the portion wound in a single layer, and the precision of winding the wire can be improved.

In the embodiment of the present disclosure, the inductor component may further comprise a pair of terminal electrodes electrically connected to the end portions of the wire and disposed on mounting surfaces of the pair of flange portions, the mounting surfaces faces a mounting board side. Connected portions where the end portions of the wire are connected to the terminal electrodes may preferably be positioned on opposite sides in a direction substantially orthogonal to the longitudinal direction of the winding core portion on the mounting surfaces. With this configuration, the wire wound around the winding core portion can be guided to the terminal electrodes with a shorter distance.

In the embodiment of the present disclosure, at least one of end turns of the wire may be wound in a single layer. With this configuration, not only the precision of winding the wire can be improved, but also the occurrence of undesired contact between the wire and the terminal electrode or solder attached to the terminal electrode can be reduced.

In the embodiment of the present disclosure, one of the plate core and the pair of flange portions may have a protrusion which is in contact with the other of the plate core and the pair of flange portions. With this configuration, the gap can be formed with stability by the protrusions.

The embodiment of the present disclosure can provide an inductor component capable of achieving satisfactory direct-current superimposition characteristics and enhancing high frequency characteristics of the inductance value and capable of achieving small capacitance at higher frequencies than the self-resonant frequency and being used in up to high frequencies exceeding about 1 GHz as a choke coil (signal block inductor).

In the embodiment of the present disclosure, resonance occurring at frequencies higher than the self-resonant frequency can be controlled, and significantly stable high frequency characteristics can be ensured.

Other features, elements, characteristics and advantages of the present disclosure will become more apparent from the following detailed description of some embodiments of the present disclosure with reference to the attached drawings.

DETAILED DESCRIPTION

An inductor component 31 according to a first embodiment of the present disclosure is described with reference to FIGS. 1 to 7.

Figure 1:
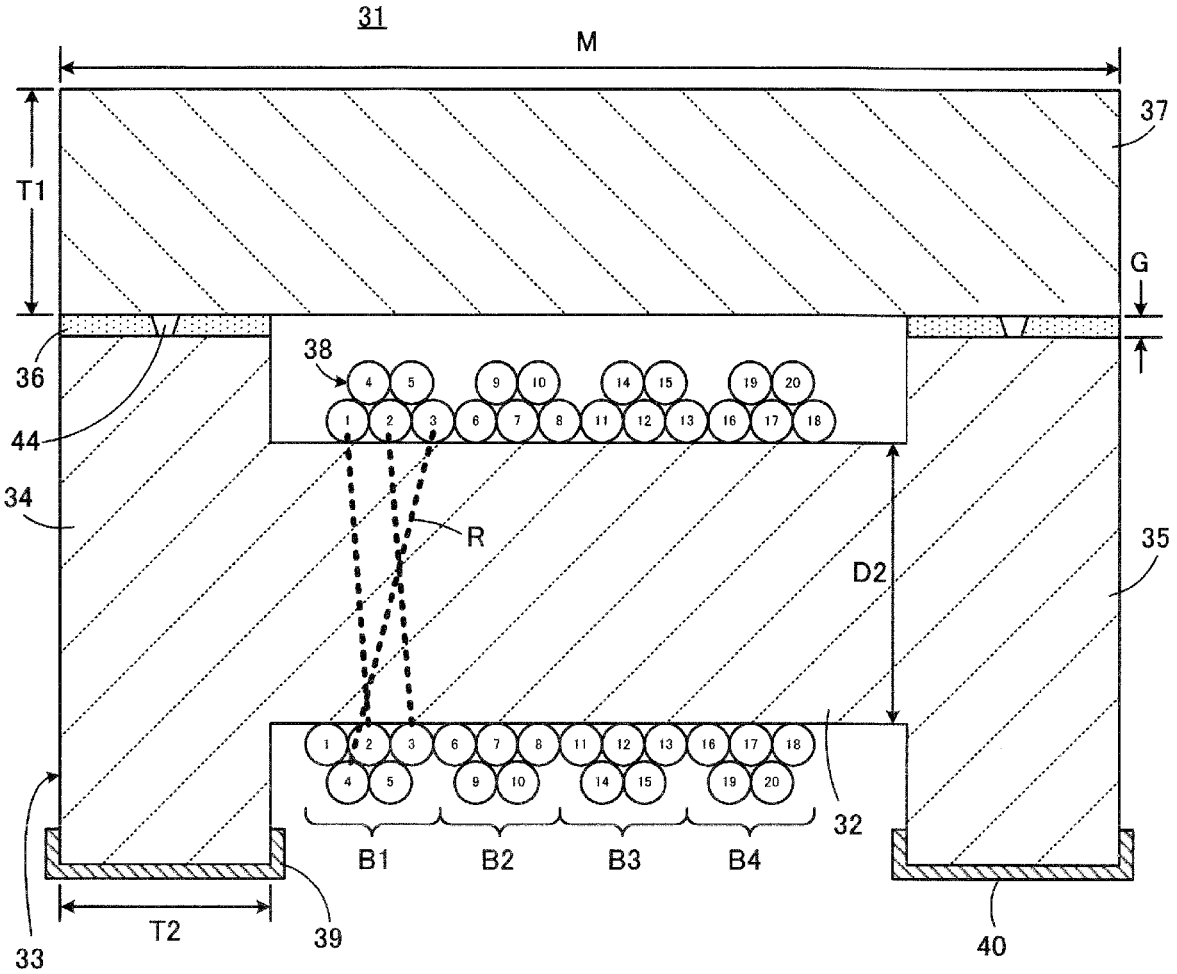
FIG. 1 is a cross-sectional view that schematically illustrates an inductor component according to a first embodiment of the present disclosure from the frontal direction.

The inductor component 31 includes a drum core 33 including a winding core portion 32 extending along the longitudinal direction, as clearly illustrated in FIG. 1. The drum core 33 includes a pair of flange portions 34 and 35 disposed on end portions of the winding core portion 32, respectively. The inductor component 31 includes a plate core 37 spanning the distance between the pair of flange portions 34 and 35 and bonded to the drum core 33 with adhesive 36 interposed therebetween. Each of the drum core 33 and the plate core 37 is made of a magnetic material, such as ferrite, and they constitute a closed magnetic circuit.

Figure 2:
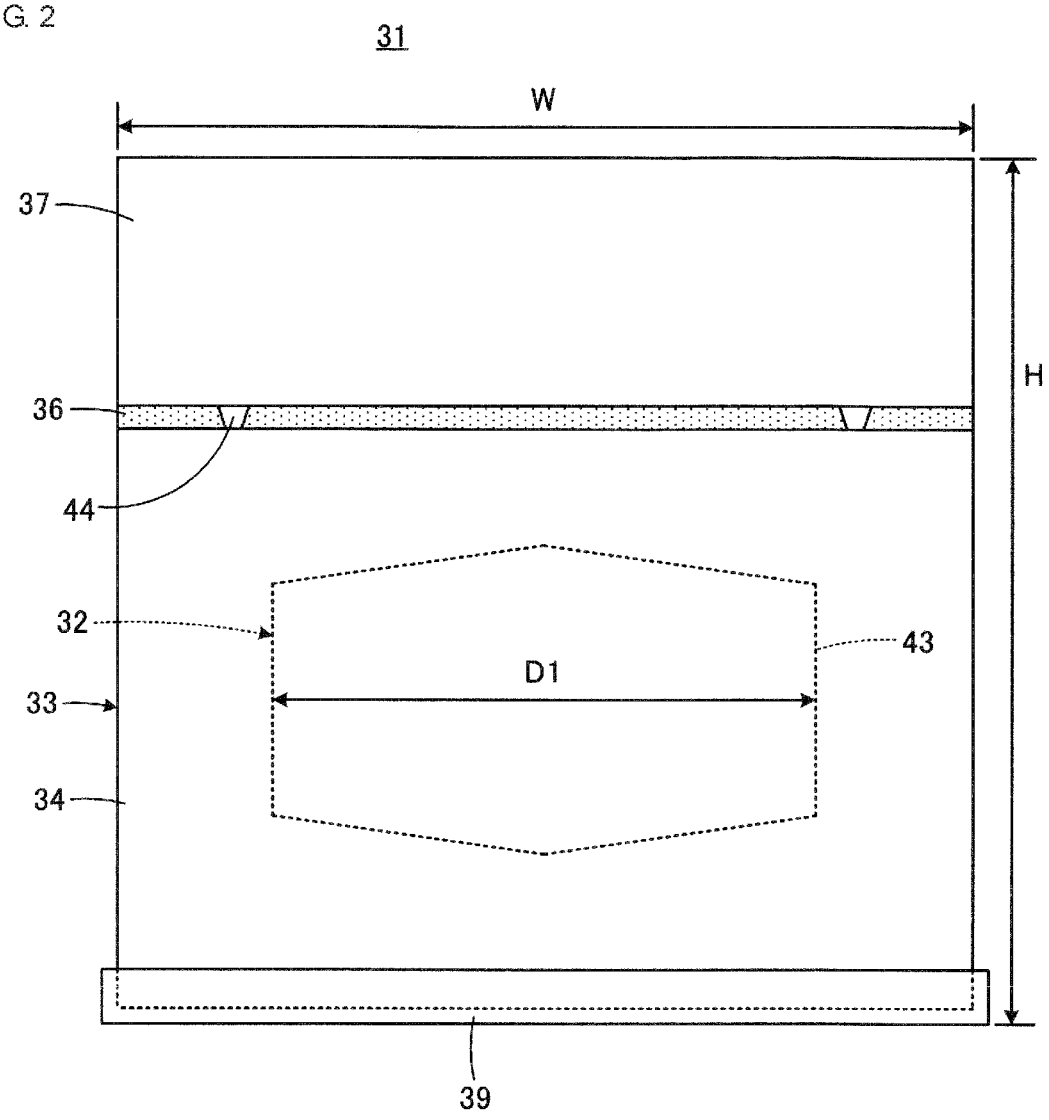
FIG. 2 is a left side view of the inductor component illustrated in FIG. 1.

The winding core portion 32 included in the drum core 33 has a substantially hexagonal cross-sectional shape similar to a rectangular shape, as indicated by a dotted line in FIG. 2, and is in a position slightly upwardly displaced from the center of the flange portions 34 and 35. The cross-sectional shape of the winding core portion 32 may be polygonal, for example, rectangular. The ridge portions at which flat surfaces of the periphery of the winding core portion 32 meet may preferably be rounded. The drum core 33, which is illustrated so as to be upwardly displaced from the center of the flange portions 34 and 35, may not be displaced or may be displaced downwardly.

Referring to FIG. 2, the inductor component 31 may have, for example, a height-direction dimension H of no less than about 2.2 mm and no more than about 2.6 mm and a width-direction dimension W of no less than about 2.2 mm and no more than about 2.8 mm. A longer dimension D1 in a cross-sectional shape of the winding core portion 32 may be no less than about 1.6 mm and no more than about 2.2 mm. Referring to FIG. 1, the inductor component 31 may have a longitudinal-direction dimension M of no less than about 2.9 mm and no more than about 3.5 mm, the plate core 37 may have a thickness-direction dimension T1 of no less than about 0.5 mm and no more than about 0.8 mm, each of the flange portions 34 and 35 may have a thickness-direction dimension T2 of no less than about 0.4 mm and no more than about 0.7 mm, and a shorter dimension D2 in a cross-sectional shape of the winding core portion 32 may be no less than about 0.7 mm and no more than about 1.1 mm.

Figure 3:
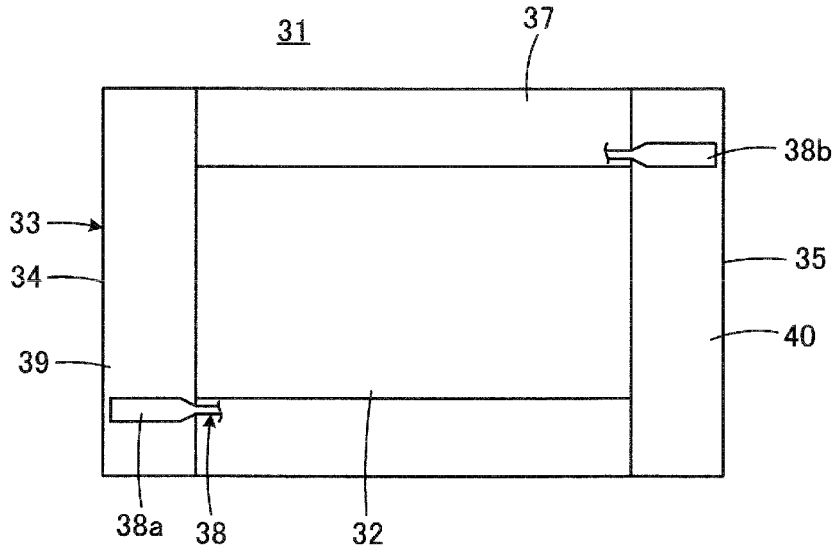
FIG. 3 is a bottom view of the inductor component, illustrating a portion where end portions of wire in the inductor component illustrated in FIG. 1 are connected to terminal electrodes.

Wire 38 is wound around the winding core portion 32. The winding mode of the wire 38 is described in detail below. First and second terminal electrodes 39 and 40 are disposed on mounting surfaces of the first and second flange portions 34 and 35, respectively, the mounting surfaces facing a mounting board (not illustrated) side. The terminal electrodes 39 and 40 may be formed by, for example, baking conductive paste, the application of plating of a conductive metal, or attaching a conductive metal piece. As illustrated in FIG. 3, the wire 38 includes first and second end portions 38*a* and 38*b* electrically connected to the first and second terminal electrodes 39 and 40, respectively. Thermocompression bonding or welding may be used in connecting these portions.

In FIG. 3, which is a bottom view that illustrates the inductor component 31 from the mounting board side, the wire 38 is omitted, except for the above-described end portions 38*a* and 38*b*.

As illustrated in FIG. 3, the connected portions where the end portions 38*a* and 38*b* of the wire 38 are connected to the terminal electrodes 39 and 40 may preferably be positioned on opposite sides in a direction substantially orthogonal to the longitudinal direction of the winding core portion 32 on the mounting surfaces of the pair of flange portions 34 and 35. With this configuration, the wire 38 wound around the winding core portion 32 can be guided to the terminal electrodes 39 and with a shorter distance. In particular, as clearly illustrated in FIG. 3, the portions connected to the terminal electrodes 39 and 40 may preferably be in the vicinity of positions that are in contact with side surfaces of the winding core portion 32 on the mounting surfaces of the pair of flange portions 34 and 35.

The terminal electrodes 39 and 40, which are disposed over the entire area of the mounting surfaces of the flange portions 34 and 35 facing the mounting board side in the present embodiment, may be disposed only on a portion sufficient for connecting the end portions 38*a* and 38*b* of the wire 38. Dummy terminal electrodes that are not connected to the end portion 38*a* or 38*b* of the wire 38 may be arranged alongside of the terminal electrodes connecting the end portions 38*a* and 38*b* of the wire 38. The dummy terminal electrodes function to strengthen mechanical fixation of the inductor component by being soldered to the mounting board side in mounting the inductor component on the mounting board.

Figure 4:
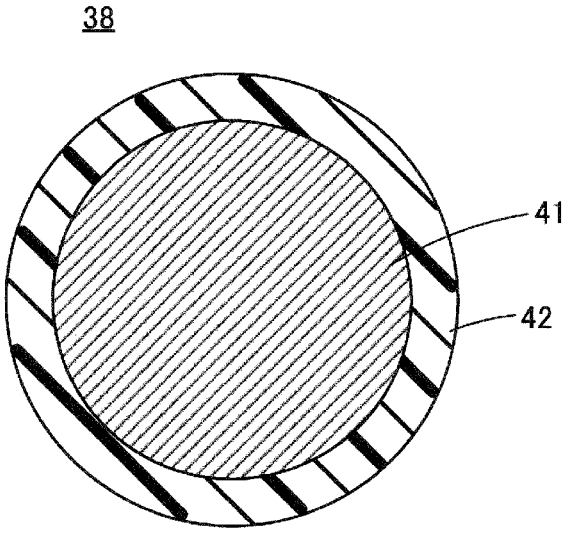
FIG. 4 is an enlarged cross-sectional view of the wire in the inductor component illustrated in FIG. 1.

An enlarged cross section of the wire 38 is illustrated in FIG. 4. The wire 38 may be made of, for example, copper and include a central conductor 41 having a substantially circular cross section with a diameter of no less than about 0.06 mm and no more than about 0.09 mm and an insulating cover layer 42 covering the circumferential surface of the central conductor 41.

In the inductor component 31, a gap G is present between the plate core 37 and the flange portions 34 and 35 and, as illustrated in FIG. 1, an average distance between the plate core 37 and the pair of flange portions 34 and 35 in the gap G is no less than about 20 μm and no more than about 50 μm. The "average distance" indicates that an arithmetic mean of measured values of the dimension of the gap G measured at five locations substantially evenly spaced in, for example, the width direction (direction indicated by W in FIG. 2) for a specimen in which the inductor component 31 is polished to have a face substantially parallel to the end face of the flange portion 34 or 35 on one side is "no less than about 20 μm and no more than about 50 μm." The five locations are set so as not to be in the round portions of the flange portions 34 and 35 or protrusions 44 produced for the purpose of forming the gap G in order to obtain an appropriate average gap.

The gap G functions as a gap interposed in a closed magnetic circuit. Thus the gap G improves the direct-current superimposition characteristics of the inductor component 31, as in the case of the technique described in Japanese Unexamined Patent Application Publication No. 2004-363178. By setting the average distance in the gap to "no less than about 20 μm," the direct-current superimposition characteristics can be sufficiently improved. In ordinary cases, the distance between the bonding surfaces when the plate core is bonded to the flange portions is smaller than about 20 μm. The gap of about 20 μm or more can be considered to be an intended gap. By setting the gap G to "no more than about 50 μm," the effect of improving the inductance produced by including the plate core 37 remains.

In this embodiment, in order to form the gap G more stably, in a portion where the plate core 37 faces the flange portions 34 and 35, the plate core 37 has the protrusions 44 which are in contact with the flange portions 34 and 35. Alternatively, the flange portions 34 and 35 may have the protrusions 44 or both the plate core 37 and the flange portions 34 and 35 may have the protrusions 44.

In FIG. 1, "1" to "20" corresponding to the ordinal numbers of turns counting from the first flange portion 34 side are indicated in the cross sections of the wire 38. Such indication of the ordinal numbers of turns in the cross sections of the wire 38 is used in FIGS. 8 to 11 described below.

The wire 38 wound around the winding core portion 32 includes four aligned banked winding portions B1, B2, B3, and B4.

The first aligned banked winding portion B1 is formed from a first turn to a fifth turn (hereinafter expressed as "turns 1 to 5") of the wire 38. That is, the turns 1 to 3 of the wire 38 are positioned on the lowest layer and spirally wound on the winding core portion 32. Then, the wire 38 is returned by approximately 1.5 turns, and the wire 38 is wound such that the turn 4 on an upper layer side is fit into a recess portion formed between the turns 1 and 2 on the lower layer side, except for a return section R described below, and then the turn 5 is fit into a recess portion formed on the turns 2 and 3 on the lower layer side.

In this first aligned banked winding portion B1, the section where the wire moves from the turn 3 to the turn 4 is a section where the wire moves from the lower layer side to the upper layer side. In this section, the wire 38 is returned in a direction opposite to the direction of travel of the wire 38 spirally wound on the winding core portion 32. Accordingly, this section is the return section R. In the return section R, the spiral winding state of the wire 38 tends to be irregular. In the present embodiment, however, the return section R lies in a specific position of the periphery of the winding core portion 32, for example, may be in a position along a sideways-directed side surface 43 of the winding core portion 32 illustrated in FIG. 2.

The second aligned banked winding portion B2 is formed from turns 6 to 10 of the wire 38. After the turn 5, which is the last turn in the first aligned banked winding portion B1 on the upper layer side, the wire 38 is moved to the lowest layer, and the turns 6 to 8 are spirally wound on the winding core portion 32 there. Then, the wire 38 is returned by approximately 1.5 turns, and the wire 38 is wound such that the turns 9 and 10 on the upper layer side are fit into recess portions formed between the turns 6 to 8 on the lower layer side, except for the return section. Here, the return section also lies in a position along the side surface 43 of the winding core portion 32.

Although not described here, substantially the same winding mode as that in the above-described case of the first and second aligned banked winding portions B1 and B2 described above is used in the third and fourth aligned banked winding portions B3 and B4.

In this way, in the inductor component 31, the four aligned banked winding portions B1 to B4 are arranged along the longitudinal direction of the winding core portion 32. More than half of the total number of turns of the wire 38 belong to the aligned banked winding portions B1 to B4. In this embodiment, almost all of the number of turns of the wire 38 belong to the aligned banked winding portions B1 to B4.

The interval between the adjacent aligned banked winding portions B1 to B4 along the longitudinal direction of the winding core portion 38 is no more than about 30 μm. This configuration can enable the wire 38 to be wound with a larger number of turns around the winding core portion 32 of a limited length, strengthen the magnetic coupling among the aligned banked winding portions B1 to B4, and contribute to achieving higher impedance.

In this embodiment, the return section lies in a position along the sideways-directed side surface 43 in the winding core portion 32 illustrated in FIG. 2. The return section may also lie in another position. The return section may not be positioned on only one side surface of the periphery of the winding core portion 32, and for example, it may be positioned on two side surfaces.

One example of the inductor component 31 may have electric characteristics with an inductance value of no less than 22 μH and no more than 56 μH, a direct-current resistance value of no less than 0.07Ω and no more than 1.2Ω, and a self-resonant frequency of no less than 25 MHz.

Figure 5:
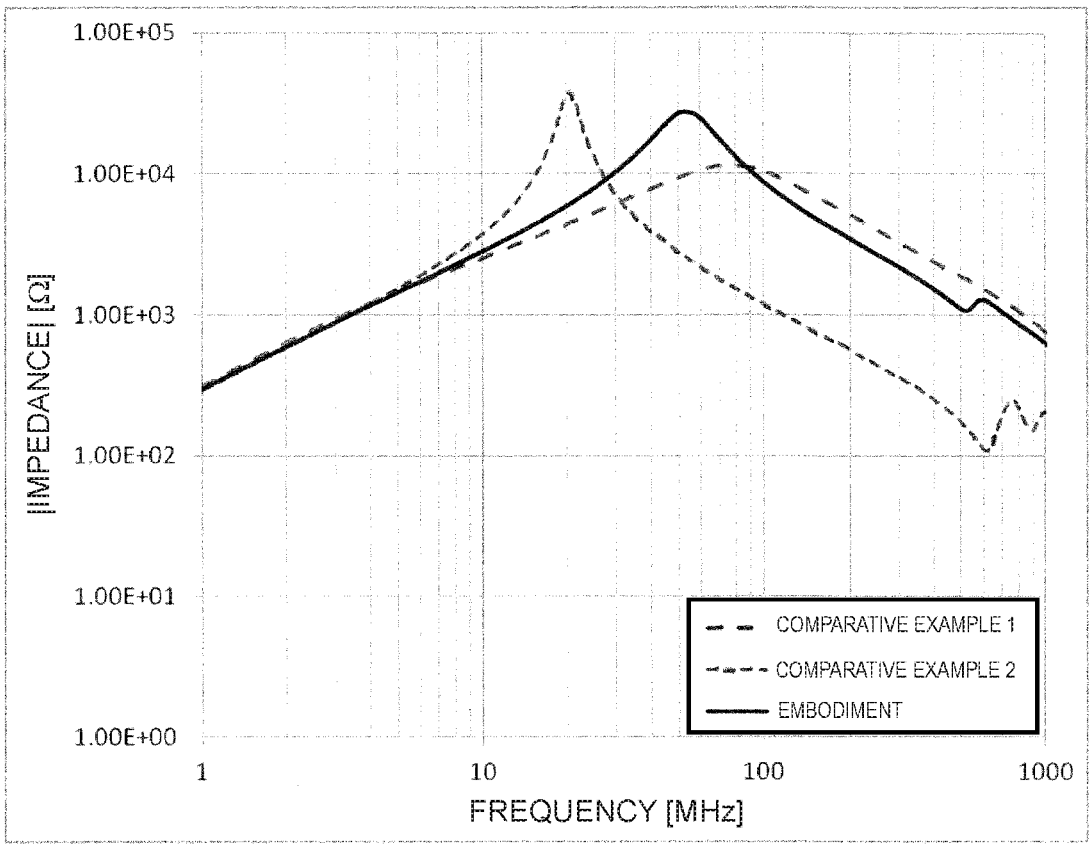
FIG. 5 illustrates the impedance-frequency characteristics of the inductor component illustrated in FIG. 1 in comparison with that in comparative examples 1 and 2.
Figure 6:
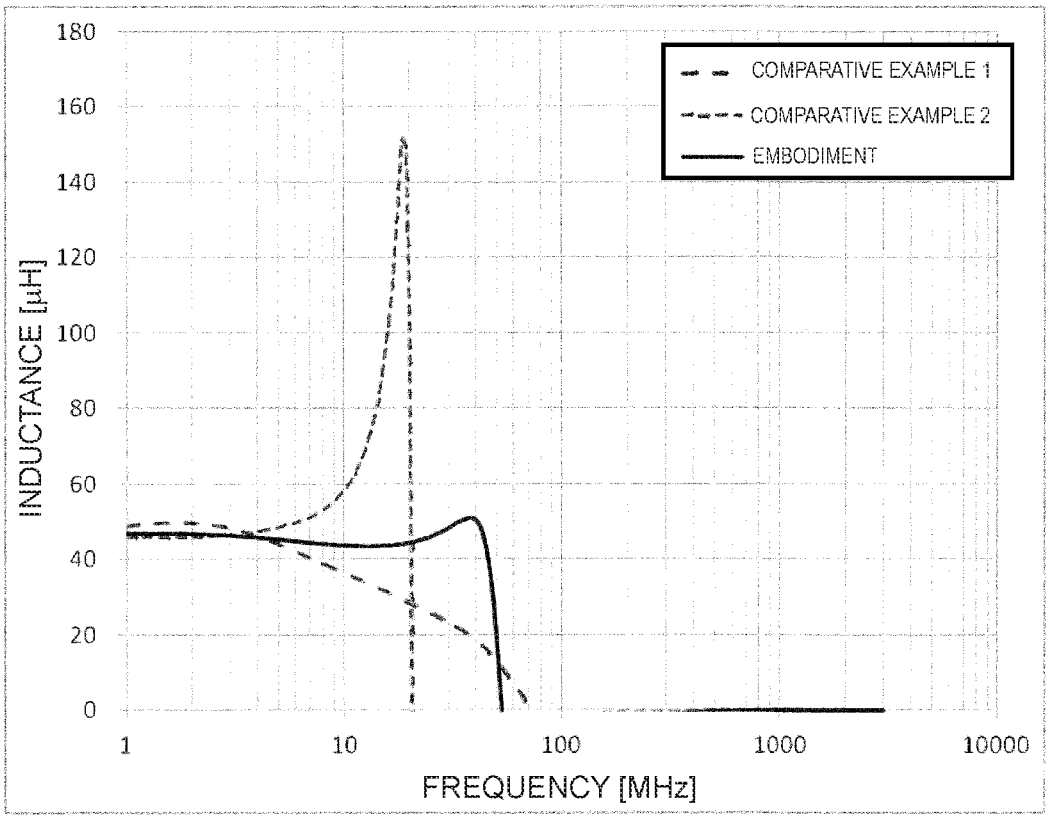
FIG. 6 illustrates the inductance-frequency characteristics of the inductor component illustrated in FIG. 1 in comparison with that in the comparative examples 1 and 2.

FIG. 5 illustrates the impedance-frequency characteristics of the inductor component 31 in the embodiment in comparison with that in comparative examples 1 and 2. FIG. 6 illustrates the inductance-frequency characteristics of the inductor component 31 in the embodiment in comparison with that in the comparative examples 1 and 2. In the comparative example 1, an inductor component with single-layer winding wire is used as a specimen. In the comparative example 2, an inductor component with banked winding wire that is unorganized (not aligned) is used as a specimen. When measurement is performed at 1 MHz, substantially the same inductance value is obtained from the inductor components in the embodiment and comparative examples 1 and 2.

Referring to FIG. 5, for the impedance characteristics, according to the present embodiment, a high inductance value can be maintained up to high frequencies in the vicinity of 1 GHz. In particular, further resonance at high frequencies exceeding a self-resonant frequency appears at a lower frequency, in comparison with the comparative example 2, which uses unorganized banked winding. In the embodiment, a higher impedance is obtained at higher frequencies exceeding a self-resonant frequency in the embodiment, in comparison with the comparative example 2. The embodiment, which uses banked winding, exhibits the impedance characteristics significantly close to that of the comparative example 1, which uses single-layer winding. This reveals that the embodiment can achieve substantially the same characteristics as those of the comparative example 1 (single-layer winding) by using a shorter winding core portion and can enable miniaturization.

Referring to FIG. 6, for the inductance characteristics, according to the embodiment, the inductance characteristics being flatter up to high frequencies exceeding about 10 MHz are obtained, in comparison with the comparative examples 1 and 2. That is, according to the embodiment, high inductance values are maintained up to higher frequencies, in comparison with the comparative examples 1 and 2, which use single-layer winding and unorganized banked winding, respectively.

Reasons for having the above-described effects are discussed below.

(1) Reasons for Good Frequency Characteristics of Inductance

In general, a magnetic material with low magnetic permeability has good high frequency characteristics. The characteristics are widely known as Snoek's limit. Thus, materials with low relative permeability are used in inductors with satisfactory high frequency characteristics. This technique enhances the high frequency characteristics by reducing the magnetic permeability microscopically.

Substantially the same effects are expected by reducing the magnetic permeability from a macroscopic viewpoint. In other words, by increasing the magnetic resistance of the entire closed magnetic circuit (that is, reducing macroscopic magnetic permeability of the entire magnetic circuit) by providing an air gap to a part of the closed magnetic circuit structure, the high frequency characteristics as the inductor can be more enhanced, in comparison with the case where no gap is provided.

In the present disclosure, by providing a gap between the drum core and the plate core, the inductance characteristics can be widened. If high inductance is obtained by using a material having low magnetic permeability with the aim of achieving both high inductance and high frequency characteristics, the direct-current superimposition characteristics are degraded. Thus the best means for achieving high inductance and high frequency characteristics is a closed magnetic circuit with a gap.

(2) Effects of Aligned Banked Winding

When a closed magnetic circuit with a gap is used, the magnetic resistance of the closed magnetic circuit is high and high inductance is not obtainable. One approach to solving this issue is the use of a banked winding structure. Typical (not aligned) banked winding has large stray capacitance and degraded high frequency characteristics (see "comparative example 2" in FIG. 6). Thus such banked winding is not used in a component needed to have high frequency characteristics in ordinary cases.

When the aligned banked winding structure illustrated in FIG. 1 is used, the stray capacitance increases slightly, but the amount of the increase can remain small. In addition, because pieces of wire in the banked portion are in close contact with each other, as is revealed from "embodiment" in FIG. 5, further resonance occurs at an early stage exceeding the self-resonant frequency, and it causes equivalent capacitance to decrease.

With the above-described effects, in actuality, the stray capacitance does not virtually increase, in comparison with that in single-layer winding (flat winding). In particular, resonance occurs at a frequency in the neighborhood of ten times the self-resonant frequency (where the resonance occurs depends on how the coil is wound), and it causes the impedance-frequency characteristics after the resonance to move upward. Because the pieces of wire in banked winding are aligned, substantially the same frequency characteristics are maintained, the characteristics after the self-resonant frequency can be controlled.

Figure 7:
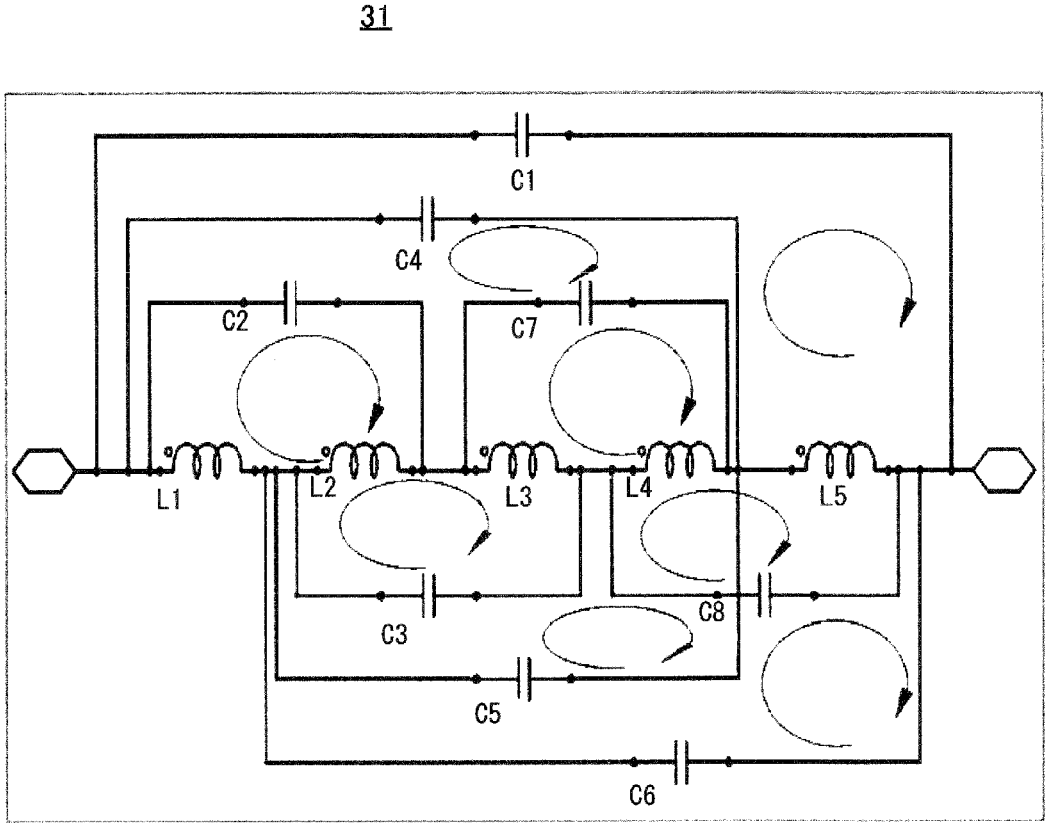
FIG. 7 is an equivalent circuit diagram of a portion that constitutes a single arranged banked winding portion in the inductor component illustrated in FIG. 1.

FIG. 7 illustrates an equivalent circuit of a single aligned banked winding portion (e.g., turns 1 to 5 in FIG. 1) in the inductor component 31. In FIG. 7, a stray capacitance C1 occurs in the entire outer shape of the aligned banked winding portion, and stray capacitances C2 to C8 occur between winding wire elements L1 to L5. Because the winding wire elements adjacent to each other extend substantially in parallel and the distance between the winding wire elements are substantially equal consistently, the capacitances are substantially the same. The inductances L1 to L5 are possessed in the turns of winding wire elements in the single aligned banked winding portion. Because the inductances L1 to L5 are near to each other, the neighboring inductances are coupled with a high coupling coefficient. The coupling coefficient is high only in low frequencies before the relative magnetic permeability of the magnetic material decreases, and it decreases in higher frequencies thereabove.

In consideration of the coupling coefficient, among the inductance values of the inductances L1 to L5, the inductance L2 at the center on the lower layer side has the largest inductance value, the inductances L1 and L3 at both ends have the smallest inductance value, and this can be referred to as a "discrete" state.

In FIG. 7, a plurality of current loops exist, as indicated with the arrows. Among the loops, one having the lowest resonant frequency appears as the self-resonant frequency, and this circuit diagram also reveals that a plurality of resonances also occurs in high frequencies above the self-resonant frequency. The impedance falls at a local frequency every time resonance occurs with a small loop, and the equivalent stray capacitance decreases at frequencies thereafter. With the aligned band winding structure, by reducing the difference between the ordinal numbers of turns of the inductances in which the stray capacitance occurs to a certain range (as small as possible), the frequency in which the local impedance fall occurs is controlled indirectly, and the entire impedance characteristics are optimized and stabilized.

Variations of the winding mode of the wire 38 in the winding core portion 32 are described below with reference to FIGS. 8 to 11. FIGS. 8 to 11 correspond to FIG. 1. The same reference numerals are used in the elements in FIGS. 8 to 11 corresponding to the elements in FIG. 1, and the redundant description is omitted.

Figure 8:
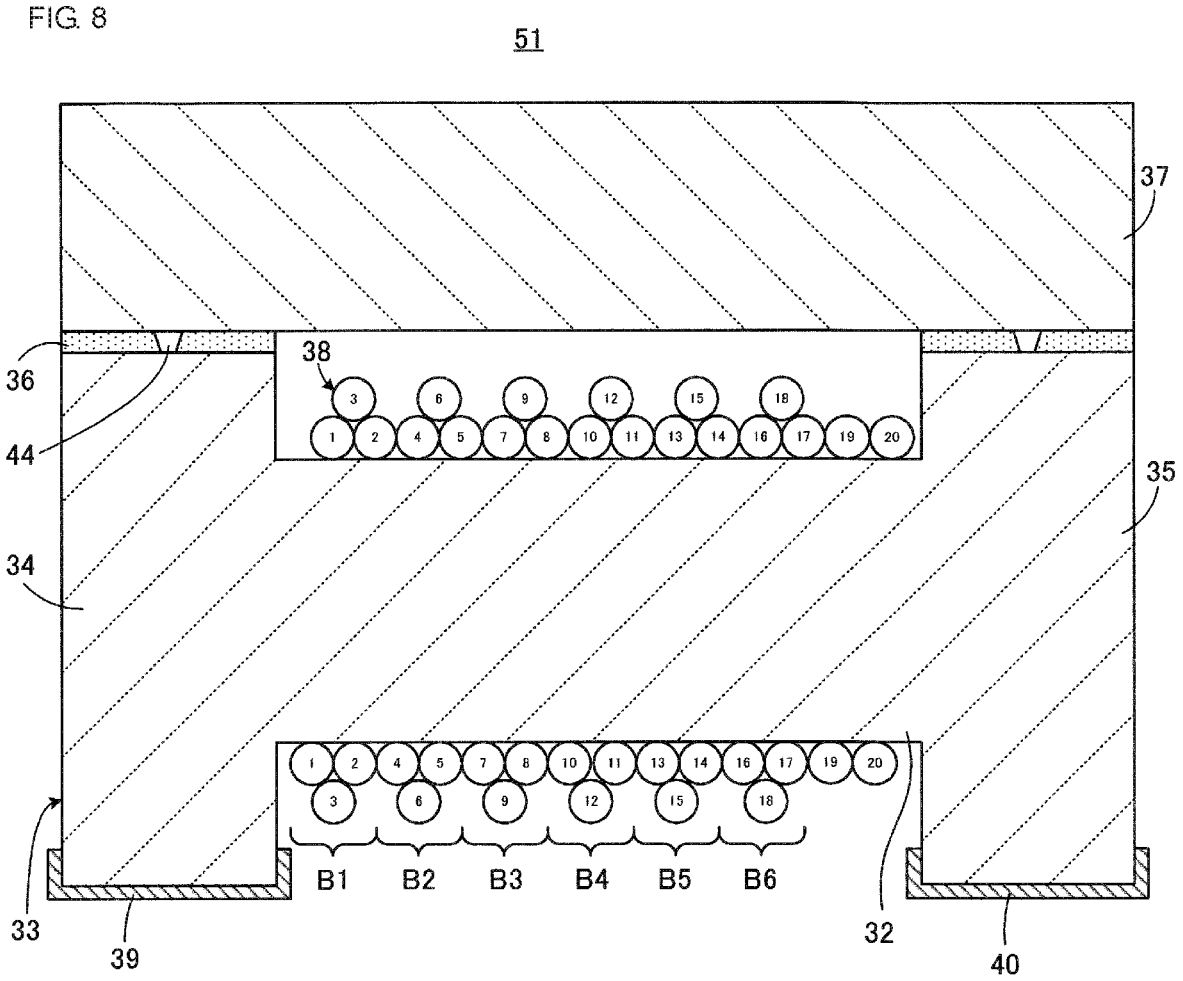
FIG. 8 is a cross-sectional view that schematically illustrates an inductor component according to a second embodiment of the present disclosure from the frontal direction.

An inductor component 51 illustrated in FIG. 8 includes wire 38 wound around a winding core portion 32, and the wire 38 includes six aligned banked winding portions B1 to B6.

The first aligned banked winding portion B1 is formed from turns 1 to 3 of the wire 38. That is, the turns 1 and 2 of the wire 38 are positioned on the lowest layer and spirally wound on the winding core portion 32. Then, the wire 38 is returned by approximately 0.5 turns, and the wire 38 is wound such that the turn 3 on an upper layer side is fit into a recess portion formed between the turns 1 and 2 on the lower layer side, except for the return section.

After that, substantially the same winding mode as that in the case of the first aligned banked winding portion B1 is used. In sequence, the second aligned banked winding portion B2 is formed from turns 4 to 6, the third aligned banked winding portion B3 is formed from turns 7 to 9, the fourth aligned banked winding portion B4 is formed from turns 10 to 12, the fifth aligned banked winding portion B5 is formed from turns 13 to 15, and the sixth aligned banked winding portion B6 is formed from turns 16 to 18.

Subsequent to the sixth aligned banked winding portion B6, the wire 38 is wound in a single layer at turns 19 and 20, and then it is connected to a terminal electrode 40.

The inductor component 51 illustrated in FIG. 8 can have a smaller stray capacitance formed between the winding wire on the lower layer side and the winding wire on the upper layer side in the aligned banked winding portions B1 to B6, in comparison with the inductor component 31 illustrated in FIG. 1.

Because the end turn of the wire 38 on a side of the flange portion 35 and the terminal electrode 40 is wound in a single layer, the inductor component 51 illustrated in FIG. 8 not only can improve the precision of winding the wire 38 but also can reduce the occurrence of undesired contact between the wire 38 and the terminal electrode 40 or solder attached to the terminal electrode 40. Note that both the end turns of the wire 38 on the sides of the flange portion 34 and 35 and the first and second terminal electrodes 39 and 40 may be wound in a single layer. The number of turns wound in the single layer continuing from the end turn of the wire 38 may preferably be about four or less.

Figure 9:
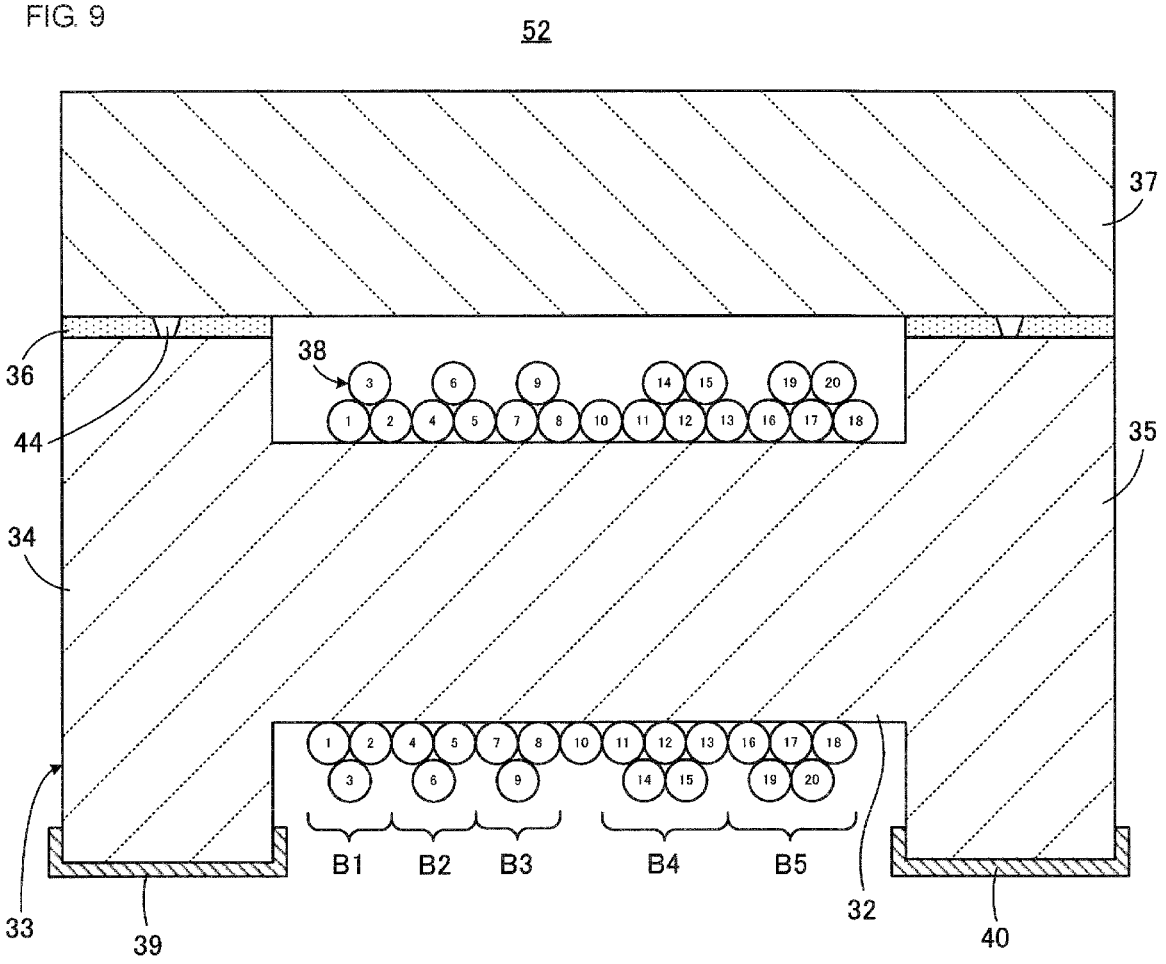
FIG. 9 is a cross-sectional view that schematically illustrates an inductor component according to a third embodiment of the present disclosure from the frontal direction.

An inductor component 52 illustrated in FIG. 9 includes wire 38 wound around a winding core portion 32, and the wire 38 includes five aligned banked winding portions B1 to B5. The first to third aligned banked winding portions B1 to B3 and the fourth and fifth aligned banked winding portions B4 and B5 are of different kinds of the aligned banked winding portion.

The first aligned banked winding portion B1 is formed from turns 1 to 3 of the wire 38. That is, the turns 1 and 2 of the wire 38 are positioned on the lowest layer, and the turns 1 and 2 are spirally wound on the winding core portion 32. Then, the wire 38 is returned by approximately 0.5 turns, and the wire 38 is wound such that the turn 3 on an upper layer side is fit into a recess portion formed between the turns 1 and 2 on the lower layer side, except for the return section.

The second aligned banked winding portion B2 formed from turns 4 to 6 and the third aligned banked winding portion B3 formed from turns 7 to 9 are substantially the same kind of the aligned banked winding portion as the first aligned banked winding portion B1.

Then, after a turn 10 is single-layer wound, the fourth aligned banked winding portion B4 is formed from turns 11 to 15. The turns 11 to 13 of the wire 38 are positioned on the lowest layer, the turns 11 to 13 are spirally wound on the winding core portion 32, then the wire 38 is returned by approximately 1.5 turns, and the wire 38 is wound such that the turns 14 and 15 on the upper layer side are fit into recess portions formed between the turns 11 to 13 on the lower layer side, respectively, except for the return section.

Then, the fifth aligned banked winding portion B5 formed from turns 16 to 20 is substantially the same kind of the aligned banked winding portion as the fourth aligned banked winding portion B4.

The present embodiment has significance in clearly stating that the wire includes a plurality of kinds of aligned banked winding portions. There are some kinds of the aligned banked winding portions such as the aligned banked winding portions with different numbers of turns or with different positions where the return sections start.

In the present embodiment, the wire 38 has the turn 10 wound in a single layer between the third aligned banked winding portion B3 and fourth aligned band winding portion B4, which are adjacent to each other. With this configuration, a discrepancy between the position of the wire 38 recognized by a winding machine and an actual position of the wire 38 that may occur in a process for winding the wire 38 can be compensated for by the portion wound in a single layer, and the precision of winding the wire 38 can be improved.

Figure 10:
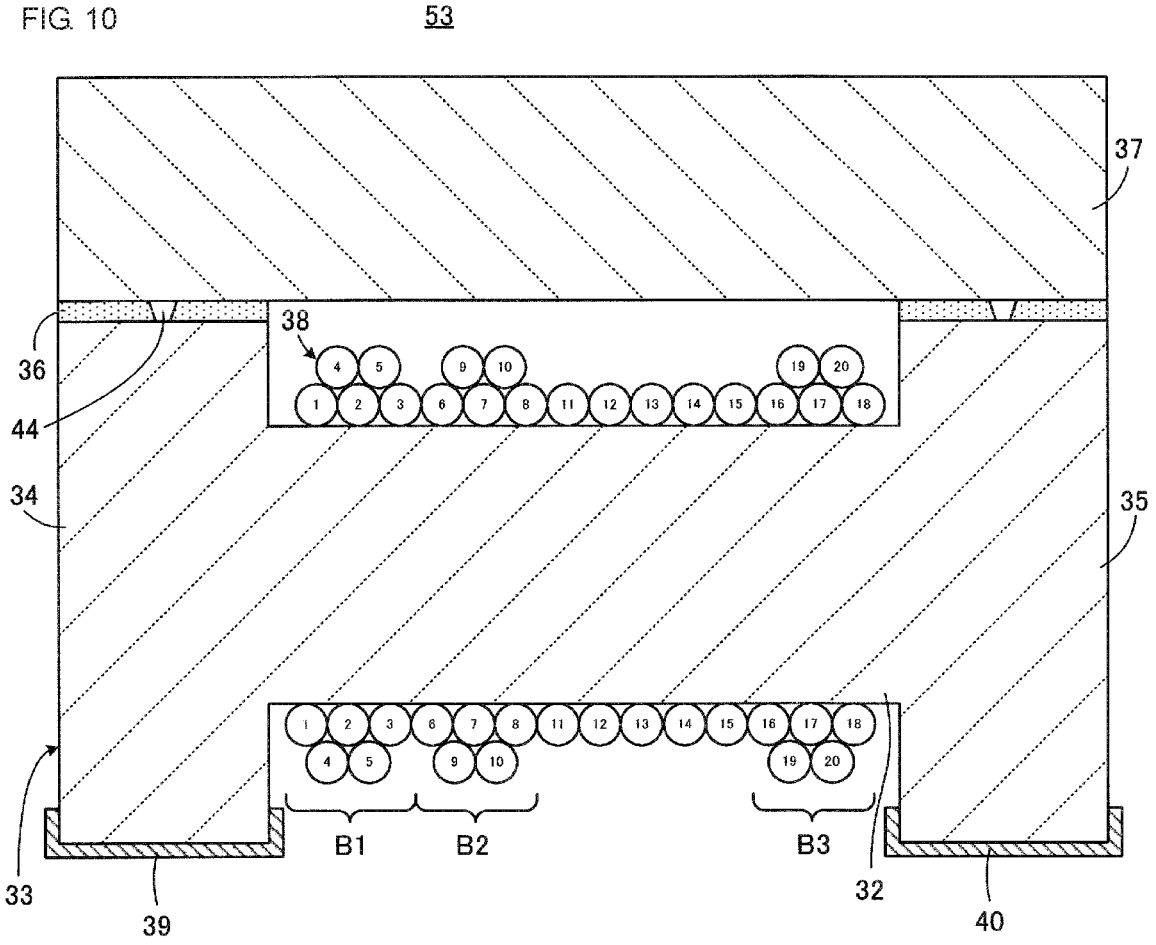
FIG. 10 is a cross-sectional view that schematically illustrates an inductor component according to a fourth embodiment of the present disclosure from the frontal direction.

An inductor component 53 illustrated in FIG. 10 includes wire 38 wound around a winding core portion 32, and the wire 38 includes three aligned banked winding portions B1 to B3 and further includes a single-layer winding portion with a relatively large number of turns between the second and third aligned banked winding portions B2 and B3.

The first aligned banked winding portion B1 is formed from turns 1 to 5 of the wire 38. That is, the turns 1 to 3 of the wire 38 are positioned on the lowest layer, and the turns 1 to 3 are spirally wound on the winding core portion 32. Then, the wire 38 is returned by approximately 1.5 turns, and the wire 38 is wound such that the turns 4 and 5 on an upper layer side are fit into recess portions formed between the turns 1 to 3 on the lower layer side, respectively, except for the return section.

The second aligned banked winding portion B2 formed from turns 6 to 10 is substantially the same kind as the first aligned banked winding portion B1.

Then, turns 11 to 15 are wound in a single layer.

After that, the third aligned banked winding portion B3 is formed from turns 16 to 20. That is, the turns 16 to 18 are positioned on the lowest layer side, the turns 16 to 18 are spirally wound on the winding core portion 32, then the wire 38 is returned by approximately 1.5 turns, and the wire 38 is wound such that the turns 19 and 20 on the upper layer side are fit into recess portions formed between the turns 16 to 20 on the lower layer side, respectively, except for the return section.

In the inductor component 53, the turns 16 to 18, in which the wire 38 is wound in a single layer, are arranged between the adjacent aligned banked winding portion B2 and B3. With this configuration, because the number of turns of the single-layer wound wire is larger than that in the foregoing inductor component 52, a discrepancy between the position of the wire 38 recognized by a winding machine and an actual position of the wire 38 that may occur in a process for winding the wire can be compensated for by the single-layer winding portion more easily, and the precision of winding the wire 38 can be improved more easily.

Figure 11:
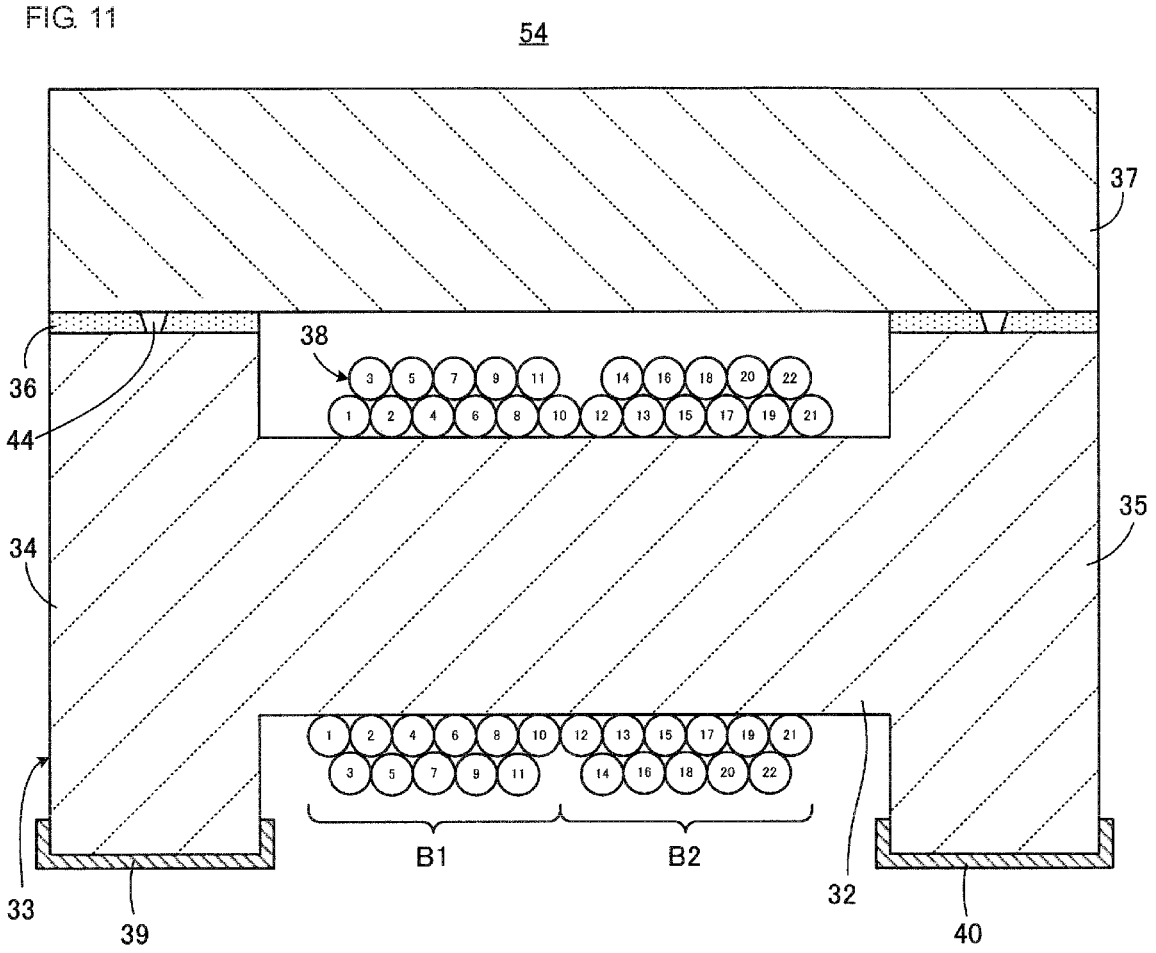
FIG. 11 is a cross-sectional view that schematically illustrates an inductor component according to a fifth embodiment of the present disclosure from the frontal direction.

An inductor component 54 illustrated in FIG. 11 includes wire 38 wound around a winding core portion 32, and the wire 38 includes two aligned banked winding portions B1 and B2. The kind of the aligned banked winding portions B1 and B2 is different from that in the above-described embodiments.

The first aligned banked winding portion B1 is formed from turns 1 to 11 of the wire 38. More specifically, the turns 1 and 2 of the wire 38 are wound on the lowest layer, then the wire 38 is returned by approximately 0.5 turns, and the wire 38 is wound such that the turn 3 is fit into a recess portion formed between the turns 1 and 2 on the lower layer side. After that, on the basis of the above-described turns 1 to 3, the turn 4 is wound on the lowest layer of the wire 38 and is returned by approximately 0.5 turns, and the turn 5 is wound on the upper layer side so as to be fit into a recess portion formed between turns 2 and 4 on the lower layer side.

Thereafter, in an analogous fashion, the turns 6 to 11 are wound on the lower layer side and on the upper layer side alternately.

After that, the second aligned banked winding portion B2 is formed from turns 12 to 22 of the wire 38. The kind of the second aligned banked winding portion B2 is substantially the same as that of the first aligned banked winding portion B1.

With the winding mode of the wire 38 used in the inductor component 54 illustrated in FIG. 11, the number of turns of the wire 38 around the winding core portion 32 with limited dimensions can be increased. This can contribute to increasing the inductance value.

The present disclosure has been described above in connection with the illustrated embodiments. The illustrated embodiments are shown by way of example, and it should be understood that the embodiments may be susceptible to various modifications to, for example, the number of turns of wire. The structures can be partially replaced and combined among the different embodiments described above.

While some embodiments of the disclosure have been described above, it is to be understood that variations and modifications will be apparent to those skilled in the art without departing from the scope and spirit of the disclosure. The scope of the disclosure, therefore, is to be determined solely by the following claims.

What is claimed is:

1. An inductor component comprising:

a drum core including a winding core portion extending along a longitudinal direction and a pair of flange portions disposed on end portions of the winding core portion;

a plate core bonded to the pair of flange portions; and a wire wound around the winding core portion, wherein the drum core and the plate core are made of a magnetic material, an average distance between the plate core and the pair of flange portions is equal to or greater than 20 μm and less than 50 μm, the wire includes aligned banked winding portions arranged along the longitudinal direction of the winding core portion, one of the plate core and the pair of flange portions has a protrusion which is in contact with the other of the plate core and the pair of flange portions, the protrusion having a height that substantially corresponds to the average distance between the plate core and the pair of flange portions, and more than half of a total number of turns of the wire belong to the aligned banked winding portions.

2. The inductor component according to claim 1, wherein the number of turns of the wire in a lowest layer that is wound in contact with the winding core portion is four or less in each of the aligned banked winding portions.

3. The inductor component according to claim 1, wherein the wire includes a plurality of kinds of the aligned banked winding portions.

4. The inductor component according to claim 1, wherein an interval between the adjacent aligned banked winding portions along the longitudinal direction of the winding core portion is no more than 30 μm.

5. The inductor component according to claim 1, wherein the wire includes a portion wound in single layer between the aligned banked winding portions.

6. The inductor component according to claim 1 further comprising a pair of terminal electrodes being electrically connected to the end portions of the wire and being disposed on mounting surfaces of the pair of flange portions, the mounting surfaces facing a mounting board side, wherein connected portions where the end portions of the wire are connected to the terminal electrodes are positioned on opposite sides in a direction substantially orthogonal to the longitudinal direction of the winding core portion on the mounting surfaces.

7. The inductor component according to claim 1, wherein at least one of end turns of the wire is wound in a single layer.

* * * * *